United States Patent [19]

Dugan

[11] Patent Number: 4,824,153

[45] Date of Patent: Apr. 25, 1989

[54] LOCK FOR SLIDING DOOR ASSEMBLY

[76] Inventor: Thomas J. Dugan, 226 Paseo de Cristobal, San Clemente, Calif. 92672

[21] Appl. No.: 935,063

[22] Filed: Nov. 21, 1986

Related U.S. Application Data

[63] Continuation of Ser. No. 678,077, Dec. 4, 1984, abandoned.

[51] Int. Cl.[4] ..... E05C 17/16

[52] U.S. Cl. ..... 292/262; 292/340; 292/241

[58] Field of Search ..... 292/241, 262, 264, 340, 292/341.17, DIG. 48, 268, 292, 297; 70/100, 98, 99, 137

[56] References Cited

U.S. PATENT DOCUMENTS

| | | | |
|---|---|---|---|
| 913,291 | 2/1909 | Hillyard et al. | 292/267 |
| 1,128,329 | 2/1915 | Kilmer | 292/268 |
| 1,447,846 | 3/1923 | Hill | 292/262 X |
| 2,217,079 | 10/1940 | Ronning | 292/262 |
| 2,786,705 | 3/1957 | Stalmer | 292/297 |
| 3,950,019 | 4/1976 | Dugan | 292/264 |
| 4,378,684 | 4/1983 | Dugan | 70/100 |
| 4,493,500 | 1/1985 | Stroup | 292/262 |

*Primary Examiner*—Richard E. Moore

*Attorney, Agent, or Firm*—Boniard I. Brown

[57] ABSTRACT

A lock for selectively locking sliding patio doors and other closures in fully closed and partially open positions and characterized by ease of installation and use.

3 Claims, 1 Drawing Sheet

LOCK FOR SLIDING DOOR ASSEMBLY

This is a continuation of co-pending application Ser. No. 06,678,077 filed on Dec. 4, 1984, now abandoned.

BACKGROUND OF THE INVENTION

1. Field of the Invention

This invention relates generally to door locks or sliding doors and other closures and more particularly to a door lock for selectively sccuring a door in its fully closed position and in a partially open position.

2. Prior Art

As it will appear from the ensuing description, the door lock of the invention may be used on a variety of doors and other closures. However, the invention is particularly designed for use on sliding patio doors and, for this reason, will be described in this context. Accordingly, it should be understood at the outset that the expression door, sliding door, and the like arc used in this disclosure in a broad sense to cover closures generally including windows, access doors, patio doors, and the like.

It is common practice to provide dwellings having patios, garden areas, and the like with sliding glass doors which open to these areas. Such sliding doors provide a large door opening and a large glass area which admits much light and ventilation to the adjacent room and provides an excellent view of the outside area.

Sliding patio doors of this kind may be left in any one of three positions. These positions are a fully closed position, a partially open position, and a fully open position. A wide variety of door locks have been devised for securing sliding patio doors in their fully closed position. One such lock is described in my U.S. Pat. No. 4,378,684, entitled "Double Cylinder Sliding Door Lock." There is no need, of course, to secure a sliding patio door in a fully open position. It is often desirable, however, to lock a sliding patio door in a partially open position which provides ventilation to the adjacent room while preventing entrance by an intruder.

A variety of door locks have been devised for securing both sliding and swinging doors in a partially open position. Examples of such door locks are bars which are placed in the sliding door track behind the sliding door panel, stops which are clamped to the trap door chains, and the like.

While these latter door locks provide the desired security in preventing further opening of a partially open sliding door, the locks suffer from certain disadvantages. One disadvantage is that they are completely separate from the main door lock which secures the door in its fully closed position. Locks of this type, therefore, require separate installation and operation of both the main door lock and the lock for securing the door in its partially open position. A disadvantage of the track mounted sliding door is that they are difficult to reach located, as they are, along the bottom track of the sliding door panel. Further, at least some of the existing locks must be completely removed and stored when not in use, which in inconvenient. Accordingly, there is a need for an improved sliding door lock which permits convenient locking of a sliding patio door, and the like, in both its fully closed position and a partially open position without requiring separate installation and operation of the closed and partially open lock components or storage of one lock component when not in use.

SUMMARY OF THE INVENTION

This invention provides an improved door lock for sliding patio doors and other doors which overcomes the above-noted and other disadvantages of the existing locks. One advantage of the present improved lock resides in the fact that it embodies a single lock structure for securing the door in both its fully closed and partially open positions, thus simplifying installation and operation of the lock. Another advantage of the lock is convenient location for both its closed and partially open locking functions. Yet a further advantage is the ability of the lock to accommodate a variety of sliding doors and the like, although as noted earlier, the lock is particularly adapted for use on sliding glass patio doors.

Simply stated, the improved lock of the invention includes a lock part and a strike part to be mounted, one on the door and the other on the door jamb, and co-acting means on these lock parts for selectively securing the door in its fully closed position and a partially open position. These co-acting means include a strike member and a securement member forming elements of the strike part and a lock member forming an element of the lock part. The lock member is movable into and from locking engagement with the strike member to lock the door in its fully closed position and into and from locking engagement with the securement member to lock the door in its partially open position.

In the present best mode embodiment of the invention, the lock part and strike part are similar to those of the door lock described in my earlier mentioned U.S. Pat. No. 4,378,684. The lock means of this lock includes a housing rotatably mounting a lock member having an arcuate free end portion forming a locking tang which is circularly curved about the rotation axis of the lock member. The strike member has a slot into and from which this locking tang is movable by rotation of the lock member between locking and unlocking positions when the door is fully closed. The door is locked in its fully closed position by rotating the lock member to its locking position to rotatably extend the locking tang into the openings in the strike member. The door is released for opening by rotating the lock member in the opposite direction to its unlocking position to rotatably retract the locking tang from the strike member.

In the present best mode embodiment of the invention, the securement member for locking the door in its partially open position is a rigid link hingably joined at one end to the strike member. This securement member or link normally hangs in a retracted position in which it clears the door for movement to its fully closed position. The link is swingable to an extended position wherein its free end is disposed to receive the curved locking tang of the lock member through an opening in the free end of the link to lock the door in its partially open position. It is impossible to disengage the locking tang and securement member, and thereby release the door for opening, without rotating the lock member to its unlocking position which may be prevented in any convenient way. For example, the lock member may not be accessible for rotation by an intruder through the space between the door and door jamb in the partially open position of the door. Alternatively, the lock may embody a key lock or the like for securing the lock member against rotation. In this latter case, the door lock may be designed for operation by a suitable key from the inside only or from both the inside and the outside of the door.

A feature of the door lock described in my earlier mentioned U.S. Pat. No. 4,378,684, resides in the fact that the lock has a key lock mechanism which is operable from both the inside and the outside by an appropriate key. Making the lock operable from the inside by an appropriate key prevents an intruder, who gains entrance to a dwelling through the front door, from exiting unnoticed through a rear patio door. The present improved lock may include a similar inside and outside key lock mechanism for the same reason.

THE PREFERRED EMBODIMENT OF THE INVENTION

Figure 1:
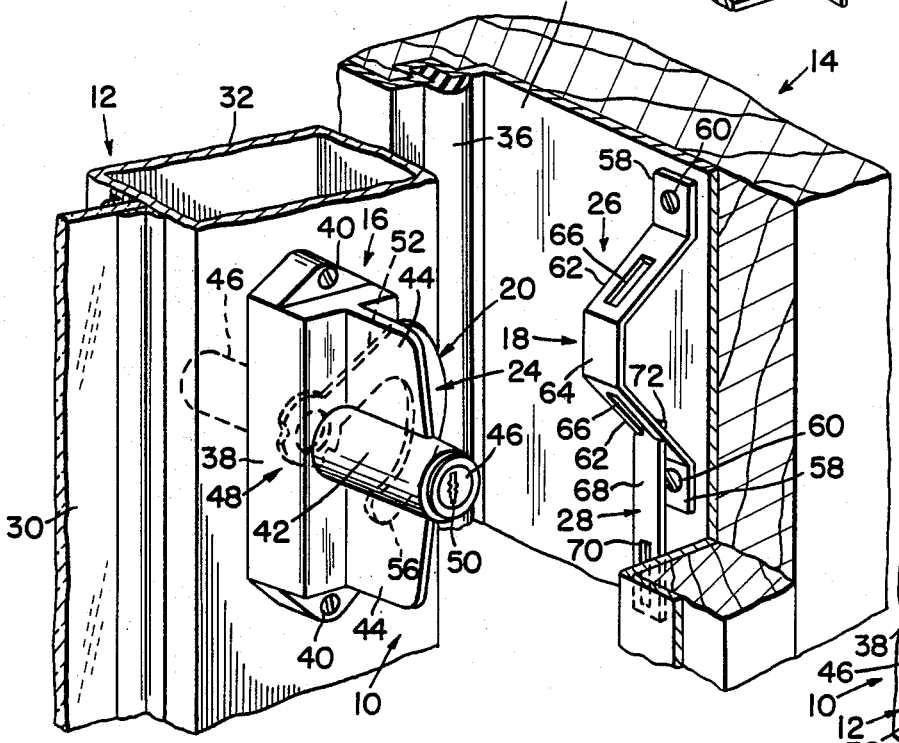
FIG. 1 is a fragmentary perspective view of an improved lock according to the invention mounted on the sliding door panel and the door jamb of a sliding patio door assembly.

Turning first to FIGS. 1 through 5 of these drawings, there is illustrated a door lock 10 according to the invention for selectively securing a door 12 in a fully closed position and a partially open position relative to the door jamb 14. The particular door 12 illustrated is a sliding patio door of the kind mentioned earlier for which the lock is particularly adapted.

While the lock is particularly adapted for this type of door, it may be used on other types of access doors, as well as on sliding windows, and other forms of closures. Thus, the term "door" is used in a broad sense to encompass not only sliding patio doors but also sliding windows and other forms of closures.

Door lock 10 includes a lock part 16 and a strike part 18 mounted, one on the door 12 and the other on the door jamb 14. Customarily, the lock part 16 is mounted on the door 12 and the strike part 18 is mounted on the door jamb 14, as shown. The lock part 16 and strike part 18 include coacting means 20 for locking the door in its fully closed position of FIG. 3 and additional co-acting means 22 for locking the door in its partially open position of FIG. 4.

Co-acting locking means 20 for locking the door in its fully closed position comprises a lock member 24 which forms an element of the lock part 16 and a strike member 26 which forms an element of the strike part 18. Co-acting lock means 22 for locking the door in its partially open position comprises the lock member 24 and a securement member 28, the latter forming an element of the strike part 18.

Figure 3:
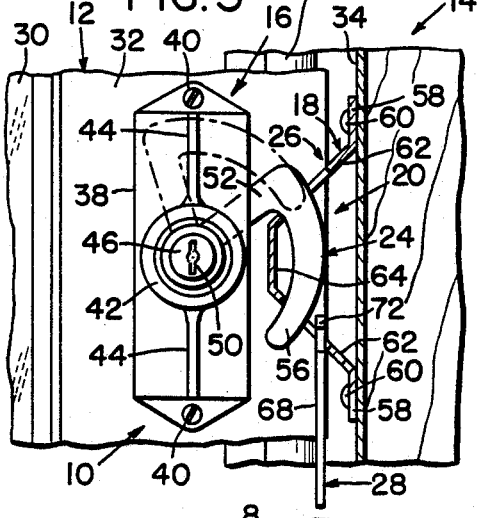
FIG. 3 is a side elevation of the lock in FIG. 1 showing the sliding door panel locked in its fully closed
Figure 4:
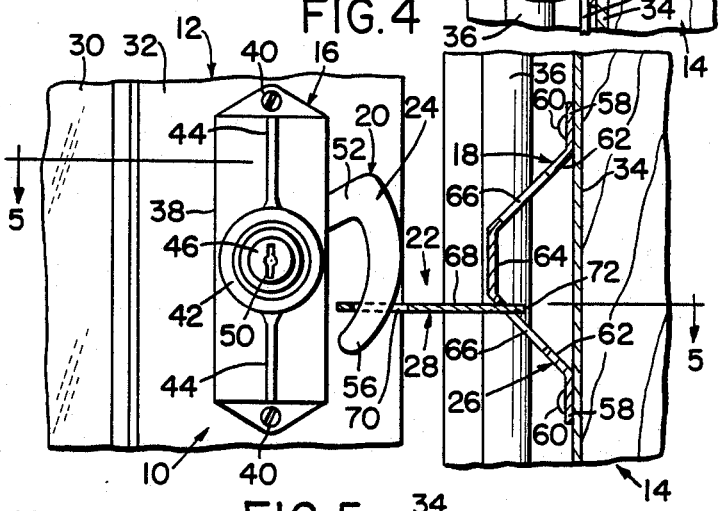
FIG. 4 is a view similar to FIG. 3 showing the sliding door panel locked in its partially open position.

Lock member 24 is rotatable between its solid line locking position and its broken line unlocking position of FIG. 3. The lock member is thus rotatable to engage and disengage the strike member 26 in the fully closed position of the door 12, as shown in FIG. 3, and to engage and disengage the securement member 28 in the partially open position of the door, as shown in FIG. 4.

Referring now in more detail to the drawings, the sliding patio door 12 is conventional and includes a glass pane 30 bounded by an aluminum frame including an upright frame member 32 which mounts the lock part 16. The door jamb 14 mounts in an extruded aluminum channel 34 which opens toward the door 12 and receives the adjacent vertical edge of the door, including the door frame member 32, when the door 12 is fully closed, as shown in FIG. 3 and again in broken lines in FIG. 5. This channel mounts a resilient sealing strip 36 which engages the door frame member 32 when the door is closed to seal the door jamb to the door.

Figure 5:
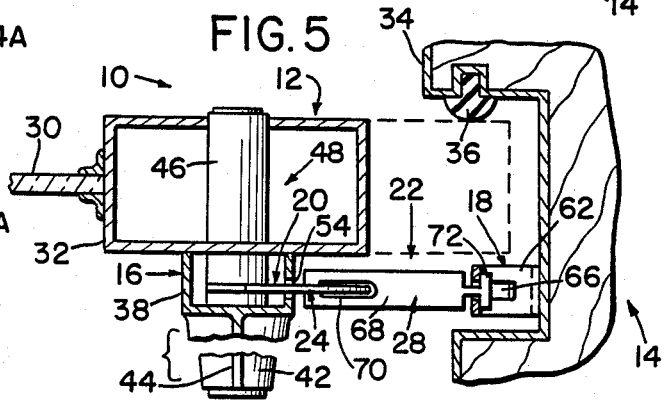
FIG. 5 is a section taken on line 5—5 in FIG. 4.

Lock means 16 has a hollow generally rectangular housing 38 secured by screws 40 to the inner side of the door frame member 32. Integral with and projecting from the lock housing 38 is a tubular barrel 42 reinforced by radial ribs 44 integral with the housing and barrel. The axis of barrel 42 passes approximately through the center of the housing 38 normal to the plane of the door 12. Rotatable in the barrel is the cylinder 46 of a key lock mechanism 48. This cylinder extends through the housing 38 and through the door frame member 32 to the outside of the door, as shown in FIG. 5. The lock cylinder is normally locked against rotation and is rotatable by an appropriate key inserted into a keyhole 50 in either end of the cylinder.

Lock member 24 is rigidly fixed to the lock cylinder 46 for rotation with the cylinder. This lock member has an arm 52 which is fixed to the cylinder and projects radially therefrom through a slot 54 in the side of the lock housing 38 and toward the adjacent vertical edge of the door 12. The lock member 24 has an arcuate free end portion 56 which is integrally joined to the outer end of the arm 52 and extends downwardly therefrom with a circular curvature centered on the rotation axis of the lock cylinder 46. This arcuate free end portion of the lock member 44 forms a locking tang.

The strike member 26 comprises a relatively rigid, generally arch-shaped strap or plate having coplanar end portions 58 which seat against and are secured by screws 60 to the door jamb channel 34. Between its ends 58, the strike member 26 has a truncated arch formed by two outwardly converging portions 62 joined at their outer extremities by a crown portion 64. Extending through the two converging portions 62 of the strike plate are slots 66 coplanar with the locking tang 56.

Lock part 16 and strike part 18 are so positioned and arranged that when the door 12 occupies its fully closed position of FIG. 3, the lock member 24 is rotatable by a key inserted into one of the keyholes 50 to extend the curved locking tang 56 into and retract the tang from the slots 66 in the strike member 26, as illustrated in FIG. 3. Extension of the locking tang into the strike member locks the door 12 in its fully closed position. Retraction of the locking tang from the strike member releases the door for opening.

As thus far described, the present improved lock 10 is very similar to that described in my earlier mentioned U.S. Pat. No. 4,378,684. According to a unique feature of this invention, the strike part 18 includes, in addition to the strike member 26, the securement member 28 for locking engagement with the lock member 24 to lock the door 12 in its partially open position of FIG. 4.

Securement member 28 comprises a relatively rigid strip or plate 68 with a longitudinal slot 70 in one end and a T-shaped formation 72 at its opposite end. This T-formation is sized and shaped to be inserted edgewise through the lower slots 66 in the strike member 26 and then rotated 90° to its use position illustrated in the drawing transverse to the plane of the slots. In this use position, the securement member is effectively hinged to the strike member for movement between its retracted position of FIG. 1 and its extended position of FIG. 4. In its retracted position of FIG. 1, the securement member 28 hangs freely downwardly from the strike member and is disposed to permit complete closure of the door 12. In its extended position of FIG. 4, securement member 28 extends generally horizontally toward the door 12 to receive the locking tang 56 of the lock member 24 through the slot 68 in the securement member by rotation of the lock member to its locking position of FIG. 4. This engagement of the lock member with the securement member is effective to lock the door 12 in its partially open position. It will be observed that in this position of locking engagement of the lock member 24 with the securement member 28, it is impossible to either rotate the securement member about its longitudinal axis into the plane of strike plate slots 66 to release it from the strike member 26 or downwardly about its T-formation 70 to disengage it from the locking tang 56. Thus, the door 12 may be released for further opening only by rotating the locking member 24 to its unlocking position and thereby retract its locking tang 56 from the securement member. Thus, the present door lock 10 permits the door 12 to be selectively locked in its fully closed position of FIG. 3 and its partially open position of FIG. 4. If desired, the lock part 16 and strike member 26 may be sold without the securement member 28 as a lock unit for locking a door in its fully closed position only. In this case, the securement member 28 may be sold separately as an attachment for the lock unit for converting the latter to a dual use lock for selectively locking a door in its fully closed position or partially open position. Alternatively, of course, the lock part 16 and strike part 18, including both the strike member 26 and securement member 28 may be sold as a complete dual function lock for locking a door in its fully closed and partially open position. In this case, the securement member 28 could be permanently hingably attached in any convenient way to the strike member 26.

Figure 7:
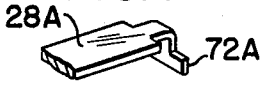
FIG. 7 is a fragmentary detail of the securement member of the lock in FIG. 6.
Figure 2:
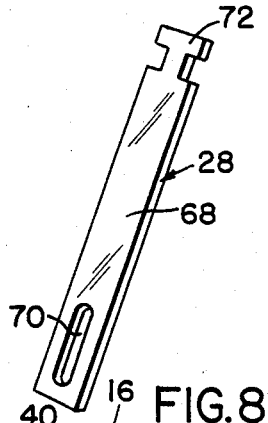
FIG. 2 is an enlarged perspective view of the securement member of the lock for securing the sliding door panel in its partially open position.
Figure 8:
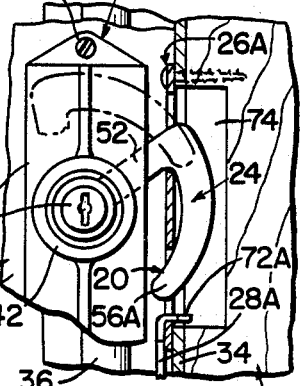
FIG. 8 is a section taken on line 8—8 in FIG. 6.
Figure 6:
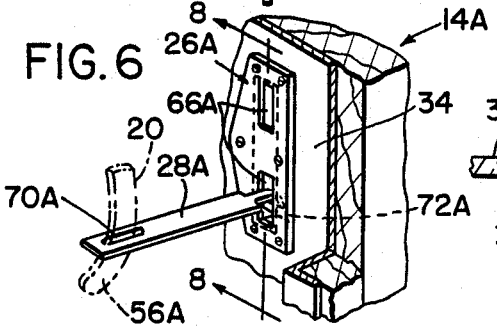
FIG. 6 is a fragmentary perspective view of a modified door lock according to the invention embodying a flat strike member.

As shown in FIGS. 6 and 7, the strike member 26A may be flat. In this case, the door jamb 14A and channel 34 are recessed and aperatured to clear the locking tang 56A when the door is locked in its fully closed position. In this fully closed position, securement member 28, whose T-end is bent at right angles as shown in FIG. 7, hangs down to clear the door. When it is desired to lock the door in a partially open position, the securement member 28 is elevated to its position of FIG. 6 wherein the securement member is disposed for engagement with the locking tang 56A of the lock member 24A.

The inventor claims:

1. A strike part for a door lock comprising:

a strike member comprising an elongate strap having opposite ends with holes to receive screws for securing said strike member to a supporting part and two spaced longitudinal slots between said ends located in a common longitudinal plane of the strap perpendicular to the side surfaces of the strap, an elongate securement strap having shaped longitudinal edges forming a T formation at and constituting one end of the securement strap, said securement strap having a certain position relative to said strike member wherein said T formation parallels and is insertable into and removable from one of said strike member slots, and wherein; said securement strap is rotatable while its T formation is positioned in said one strike member slot to locate said T formation crosswise of said one slot and thereby lock said securement strap to said strike member strap, and said securement strap while thus locked to said strike member is pivotally rotatable relative to said strike member and in said common plane of said slots.

2. A lock to be installed on a door assembly including a door and a door jamb for selectively locking the door in a fully closed position and a partially opened position, comprising:

a lock part and a strike part to be mounted one on the door and the other on the jamb, said strike part including a strike member and a securement member connected to said strike member for movement of said securement member to extended and retracted positions relative to said strike member and disengagement from said strike member, said lock part including a rotary locking member which is selectively engageable in locking relation with said strike member when said securement member occupies its retracted position to lock said door in its fully closed position and with said securement member when the latter member occupies its extended position to lock the door in its partially opened position, and wherein:

said locking member has an arcuate free end portion forming a curved finger-like locking tang and is rotatable to rotate said locking tang endwise, said strike member comprises a strap having slot means for receiving said locking tang in said locking relation of said locking member with said strike member, said securement member comprises an elongate strap having a slot in one end for receiving said locking tang in locking engagement with the securement strap and a T formation at the other end, said securement strap is movable relative to said strike member to align said T formation parallel to said strike member slot means for insertion of said T formation into and removal of said T formation from said strike member slot means and to position said T formation transverse to said slot means to lock said securement strap against disengagement from said strike member, and said securement strap when locked against disengagement from said strike member is movable to said extended position wherein said locking tang is engageable in said securement strap slot to prevent alignment of said securement strap T formation parallel to said strike member slot means and thereby disengagement of said securement strap from said strike member, and to said retracted position wherein said securement strap permits engagement of said locking tang in said strike member slot means.

3. In a sliding door assembly including a jamb and a sliding door movable edgewise in a plane toward said jamb to a fully closed position wherein a vertical edge of the door is situated adjacent said jamb and away from said jamb through a partially opened position to a fully opened position, and a lock for locking said door in said fully closed and partially opened positions, said lock comprising:

a lock part and a strike member, means mounting said lock part and said strike member one on the door jamb and the other on the adjacent vertical edge of the door, said lock part including a locking member rotatable on an axis normal to said plane and having an arcuate free end portion forming a finger-like locking tang curved about said axis and disposed in a second plane normal to said axis for rotation of said locking tang in said second plane about said axis by rotation of said locking member, said strike member comprising a strap having a slot means located in said second plane for rotation of said locking tang into and from locking engagement with said strike member wherein said tang extends through said slot means when said door occupies its fully closed position, securement means for locking the door in said partially opened position including a rigid elongate securement strap having an opening in one end, and means connecting the other end of said securement strap to said strike member for pivotal movement of said securement strap between a retracted position in which the securement strap hangs downwardly from said strike member and permits full closing of the door to accommodate locking engagement of said locking tang in said strike member slot means to lock the door in its fully closed position, and an extended position in which said securement strap extends from said strike member toward said lock part and said locking tang is rotatable into and from locking engagement with said securement strap wherein the tang extends through the securement strap opening when said door occupies its partially open position, thereby to lock the door in said partially open position, and wherein said connecting means for said securement strap comprises a T formation at said other end of said securement strap insertable into and removable from a slot in said strike member strap when said securement strap occupies a certain position relative to said strike member, and said securement strap is rotatable to a position wherein said T formation is transverse to said strike member slot to lock said securement strap to said strike member, and said securement strap opening is disposed to receive said locking tang when said securement strap occupies its extended position.

* * * * *